US005767884A

United States Patent [19]

Bortolotti et al.

[11] Patent Number: 5,767,884

[45] Date of Patent: Jun. 16, 1998

[54] INK JET PRINTER WITH PRINTED SHEETS STACKING DEVICE

[75] Inventors: Giuseppe Bortolotti, Yverdon-Les-Bains; Alain Tabasso, Essertines, both of Switzerland

[73] Assignee: Olivetti-Canon Industriale S.p.A., Ivrea, Italy

[21] Appl. No.: 802,346

[22] Filed: Feb. 11, 1997

[30] Foreign Application Priority Data

Feb. 29, 1996 [CH] Switzerland ..... 00528/96

[51] Int. Cl.[6] ..... B41J 2/01

[52] U.S. Cl. ..... 347/102; 347/37; 347/104; 400/185; 400/320; 400/625; 271/213; 271/218

[58] Field of Search ..... 347/101, 104, 347/102, 37; 400/185, 320, 322, 625; 271/213, 218, 207, 145, 157, 158

[56] References Cited

U.S. PATENT DOCUMENTS 4,872,026 10/1989 Rasmussen et al. ..... 347/37

5,536,000 7/1996 Kelly ..... 347/102

5,603,493 2/1997 Kelly ..... 347/102

*Primary Examiner*—N. Le

*Assistant Examiner*—Juanita Stephens

*Attorney, Agent, or Firm*—Banner & Witcoff, Ltd.

[57] ABSTRACT

The printer comprises an entrance, a printing station, a collection tray for the printed sheets and temporary storage mechanisms on which a printed sheet is placed immediately after printing. These mechanisms comprise pivotingly mounted shutters, opening and closing of which is commanded by a slide comprising two rails cooperating with levers integral with the shafts of the shutters. The slide can be made temporarily integral with the printing carriage by means of a selection pin, the cams of which cooperate with two fixed abutments. The carriage thus performs selection and driving of the temporary storage mechanisms, which are easy to build and operate precisely at a low cost price.

9 Claims, 6 Drawing Sheets

INK JET PRINTER WITH PRINTED SHEETS STACKING DEVICE

TEXT OF THE DESCRIPTION

1. Field of the Invention

This invention concerns an ink jet printer comprising a frame, an entrance for the sheets to be printed, a printing station with a printing carriage moved in a direction of movement perpendicular to the feeding direction of the sheets, a collection tray for the printed sheets with temporary storage means located above the collection tray and means for feeding the sheets from the entrance to the tray.

2. Related Technological Art

Printers of this type using inks that dry relatively slowly require temporary means of storing the printed sheet designed to avoid this sheet being immediately stacked directly on top of the sheet printed before, which would cause smearing on the latter since the ink has not dried sufficiently. Smearing would be accentuated by the fact that the sheet is deposited by sliding on the sheet printed before.

SUMMARY OF THE INVENTION

The object of this invention is to produce a printer provided with temporary storage means of extremely reliable operation, allowing precise stacking of the printed sheets, controlled by an easy-to-build actuating mechanism, requiring very few components and increasing overall dimensions of the printer only slightly, at a moderate cost price.

The printer of this invention is accordingly characterized by the fact that the temporary storage means comprise two retractable shutters, pivotingly mounted according to a pivoting axis that is perpendicular to the said direction of carriage movement and an actuating mechanism designed to make the two shutters pivot, comprising a slide capable of being moved in two opposite directions parallel to the direction of movement and suitable for cooperating with the shutters, and temporary linking members between the carriage and the slide arranged so that movement of the carriage commands movement of the said slide to close the said shutters, so that a printed sheet is placed on the shutters, and to open the shutters, so that this printed sheet is dropped vertically downwardly into the collection tray.

Efficient operation of the temporary storage means can be obtained from the features described above, in addition to an actuating mechanism that is simple to build, has few components and comes at a low cost price, while only slightly increasing overall dimensions of the printer.

The functions of these storage means can all be produced from a short return overtravel of the carriage, which performs selection and driving of the means in question.

To advantage, each of the shutters or each of the axes of the shutters comprises a member intended for cooperating with a rail provided on the slide and arranged so as to actuate this member in order to open and close the shutters when the slide is moved by the carriage.

Shutter opening and closing is commanded in a simple and precise way.

According to a preferred embodiment, the slide comprises a recess intended for cooperating with a protrusion provided in the carriage, a retaining member being fitted on the slide so as to cooperate with at least two fixed abutments and be put in the closed position, where the protrusion is integral with the recess, and be put in the open position, in which the protrusion and the recess are no longer integral.

These characteristics ensure a shutter opening command that is very simple and effective.

To advantage, a first of the fixed abutments is arranged so that the retaining member cooperates with it when the carriage performs a lateral, selecting overtravel beyond the printing position to make the carriage integral with the slide and a second of the fixed abutments is arranged so as to open the retaining member when the slide has performed a stroke sufficient to cause the shutters to open.

The shutter open selection command is obtained from a very short overtravel of the carriage, allowing encumbrance of the printer width-wise to be kept very low. Moreover, selection is made very precisely and very simply.

According to a preferred embodiment, the retaining member consists of a selection pin rotatingly fitted on the slide between two stop positions and comprising a recess which the said protrusion enters through an opening in one of the stop positions of the selection pin, the latter comprising at least one cam designed to cooperate with the two fixed abutments so as to be turned from one stop position to the other stop position and vice versa.

These are characteristics that ensure precise and reliable operation, while keeping cost price low.

Advantageously each of the shutters is formed by a cylindrical member having a section in the form of the arc of a circle with an angle of between 50° and 100°, preferably between 65° and 90°, this arc of a circle being extended towards the inside of the temporary storage means by an essentially flat part.

Thus precise sheet alignment and suitable guidance for movement of the shutters may be obtained.

Other advantages are apparent from the features described in the associated claims and from the description relating the invention in greater detail, in conjunction with the drawings schematically depicting one embodiment by way of example.

DETAILED DESCRIPTION OF THE PREFERRED EMBODIMENT

Figure 1A:
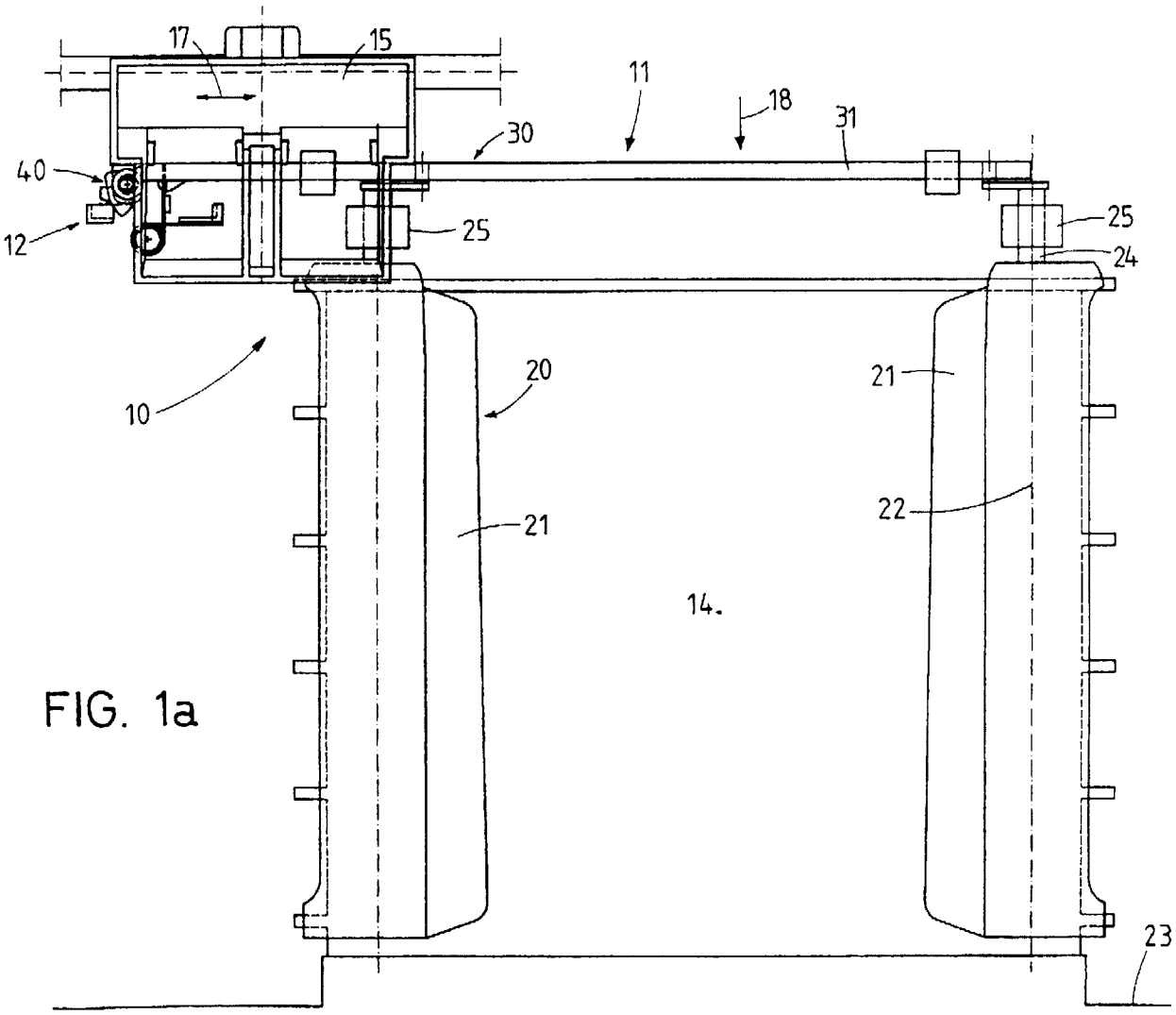
FIGS. 1*a* and 1*b* are perspective views and transverse sectional views of this embodiment in a first position, with the shutters closed.
Figure 1B:
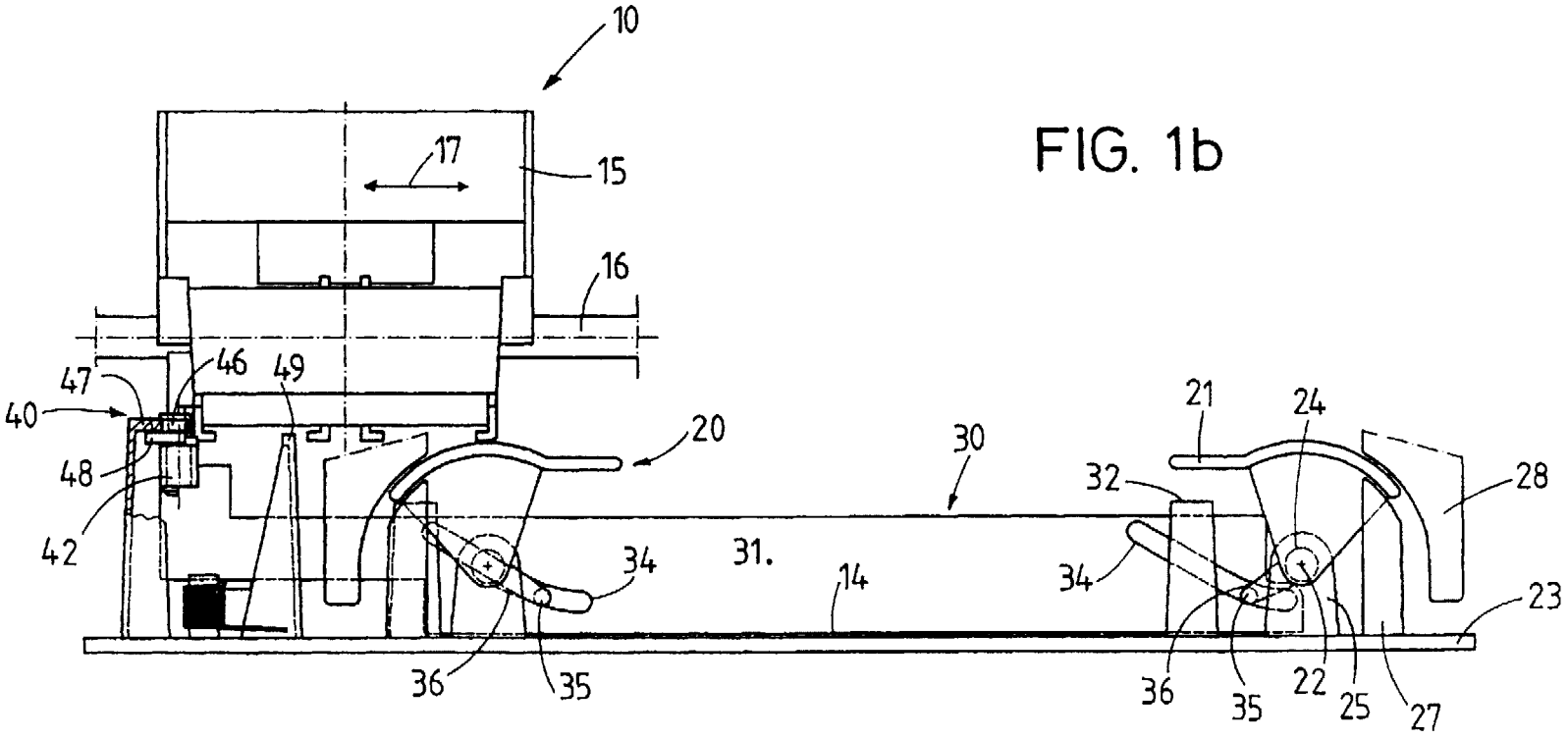

The printer 10 shown in FIGS. 1*a* and 1*b* comprises an entrance 11 for the sheets to be printed, or for all other materials to be printed, such as envelopes, cardboard paper, etc., a printing station 12, a collection tray 14 for the printed sheets and means (not illustrated) for feeding the sheets from the entrance to the collection tray 14.

In the printing station 12, a printing carriage 15 is moved on a shaft 16 following a direction of movement 17 perpendicular to the feeding direction 18 of the sheets. The printer comprises temporary storage means 20 on which a printed sheet, not shown in figures, is placed immediately after printing.

These means 20 are placed above the collection tray 14 and allow the ink to dry on the sheet printed before, since the sheet just printed is not placed directly on top of it.

These temporary storage means 20 comprise two retractable shutters 21 pivotingly mounted according to a pivoting axis 22 on the frame 23 of the printer. Each of the shutters at one end has a shaft 24 held in a support 25 integral with the frame 23. Each shutter 21 is guided in its pivoting movement by internal 27 and external 28 guiding members. This dispenses with the need for a second shaft at the other end of the shutters 21, thereby providing the temporary storage means 20 with maximum useful surface area and low encumbrance.

The shutters 21 can be retracted simultaneously thanks to an actuating mechanism 30. The latter comprises a slide 31 in the form of a slat fitted in two posts 32 so as to slide in two opposite directions parallel to the direction of movement 17 of the carriage 15. Two rails 34 in the form of guide rails provided in the slide 31 cooperate with pins 35 of levers 36 integral with the shafts 24 of each of the shutters 21. Accordingly when the slide 31 is moved in the direction 17 to the right, the shutters 21 are moved from an active position shown in FIGS. 1*a* and 1*b* to a retracted position shown in FIGS. 4*a* and 4*b* in which each shutter 21 is partly introduced between the guiding members 27 and 28. The slide 31 is actuated by the carriage 15 by means of temporary linking members 40 intended for linking the carriage to the slide illustrated more clearly in FIGS. 2 to 4. These members 40 comprise a rod 41 integral with the carriage 15 designed to cooperate with a selection pin 42 borne by the slide 31. This selection pin 42 is pivotingly mounted between two stop positions on the slide 31 and comprises a central recess 43 with an opening 44 permitting entry of the rod 41. It is equipped with an upper cam 46 designed to cooperate with a fixed abutment 47 and a lower cam 48 designed to cooperate with a fixed abutment 49.

Figure 2A:
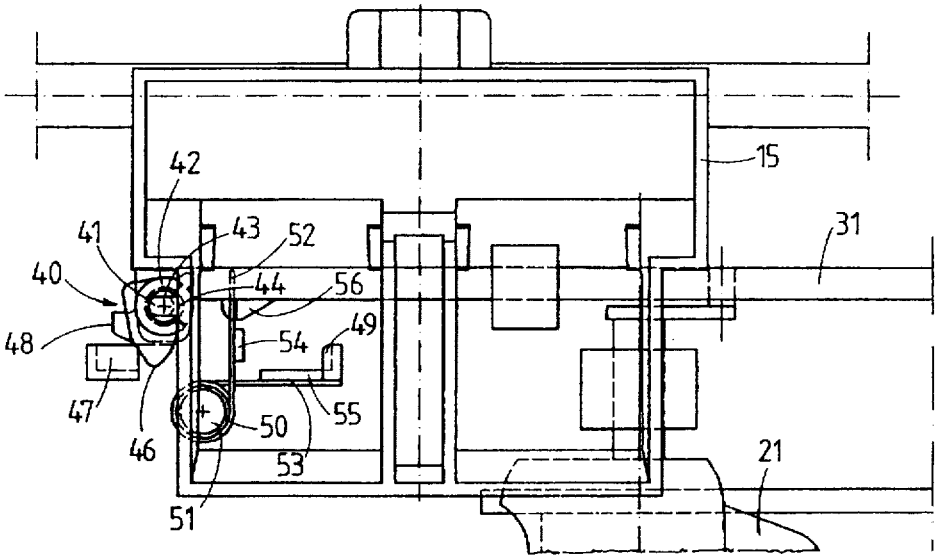
FIGS. 2*a* and 2*b* are enlarged perspective and sectional views of part of the printer in the first position.
Figure 2B:
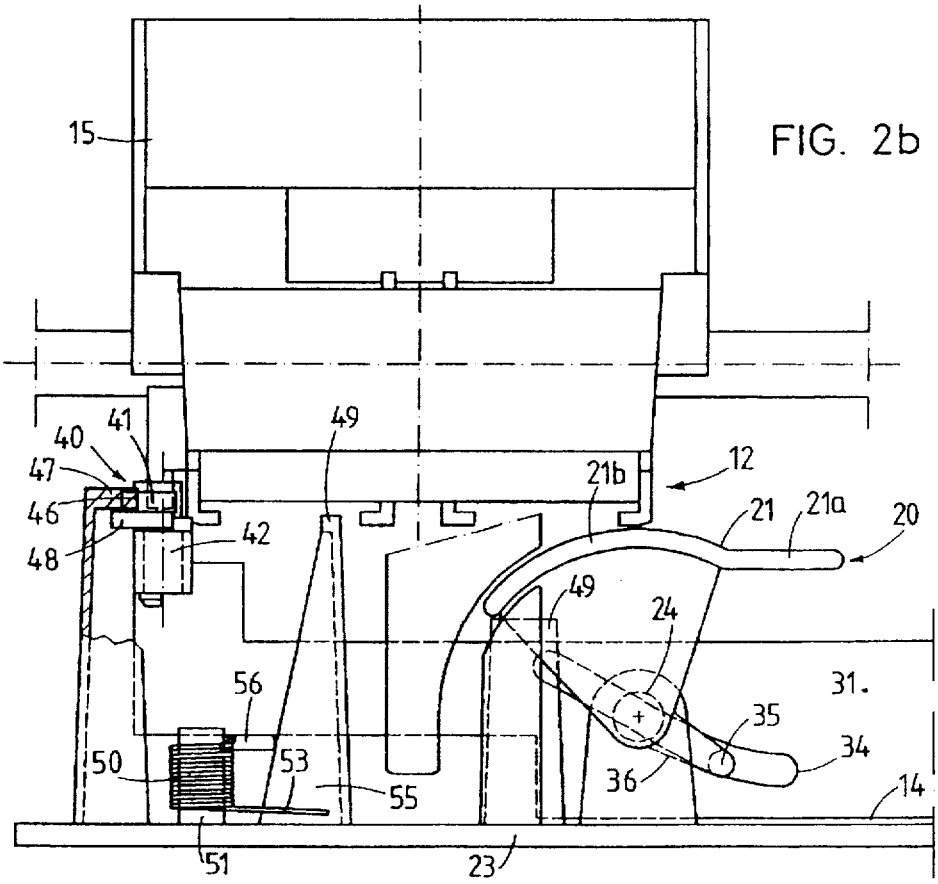
Figure 3A:
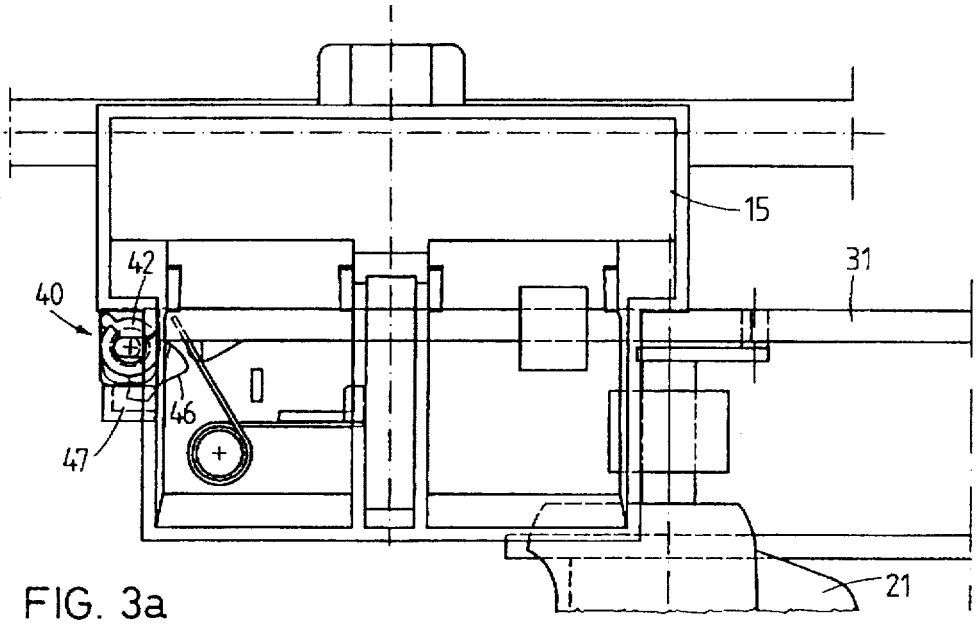
FIGS. 3*a* and 3*b* are enlarged perspective and sectional views of the same part in a second position corresponding to selection of the shutter open command.
Figure 3B:
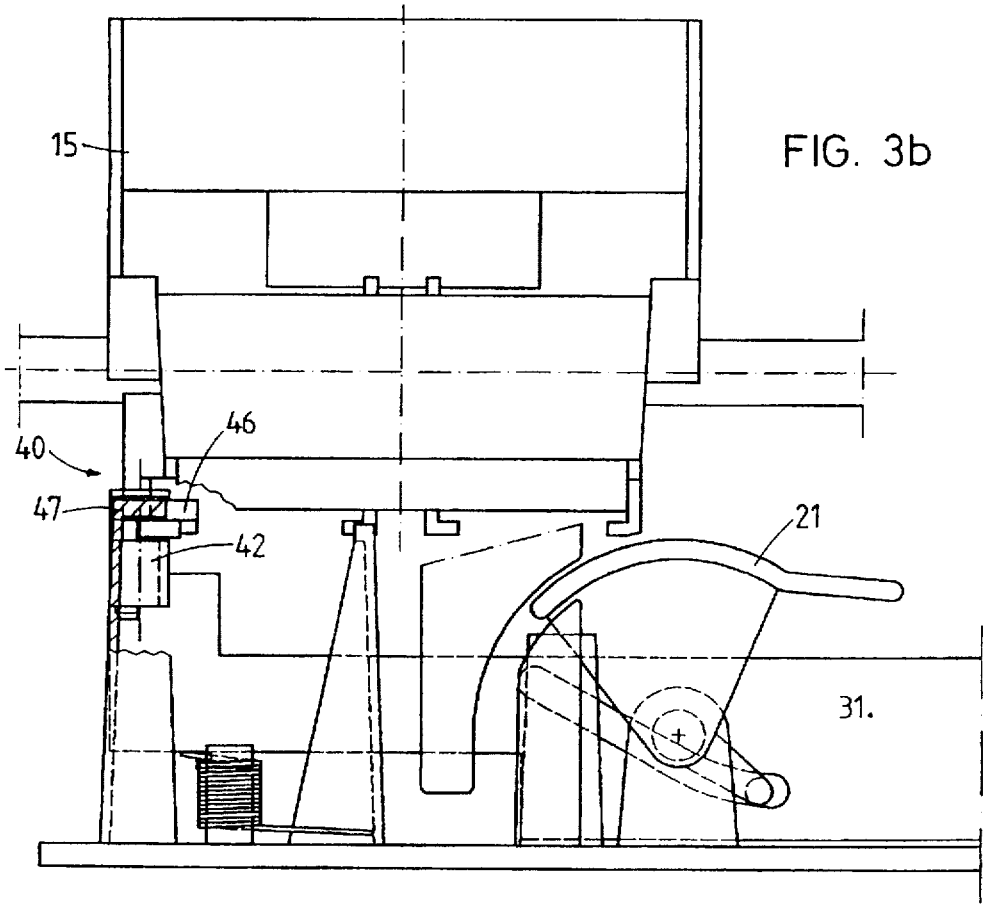

Accordingly, when the carriage is moved from the position illustrated in FIGS. 2*a* and 2*b* to the selection position illustrated in FIGS. 3*a* and 3*b*, the rod 41 enters the recess 43 and pushes the slide 31 slightly, by about 6 mm, to the left.

Meanwhile, the abutment 47 cooperating with the cam 46 turns the selection pin 42 through an angle of about 90° in the anticlockwise direction. The rod 41 cannot escape from the recess 43 through the opening 44 and when the carriage 15 is moved to the right in FIGS. 3*a* and 3*b*, it takes with it the slide 31 which puts the shutters 21 in rotation by means of the rails 34 and the levers 36.

Figure 4A:
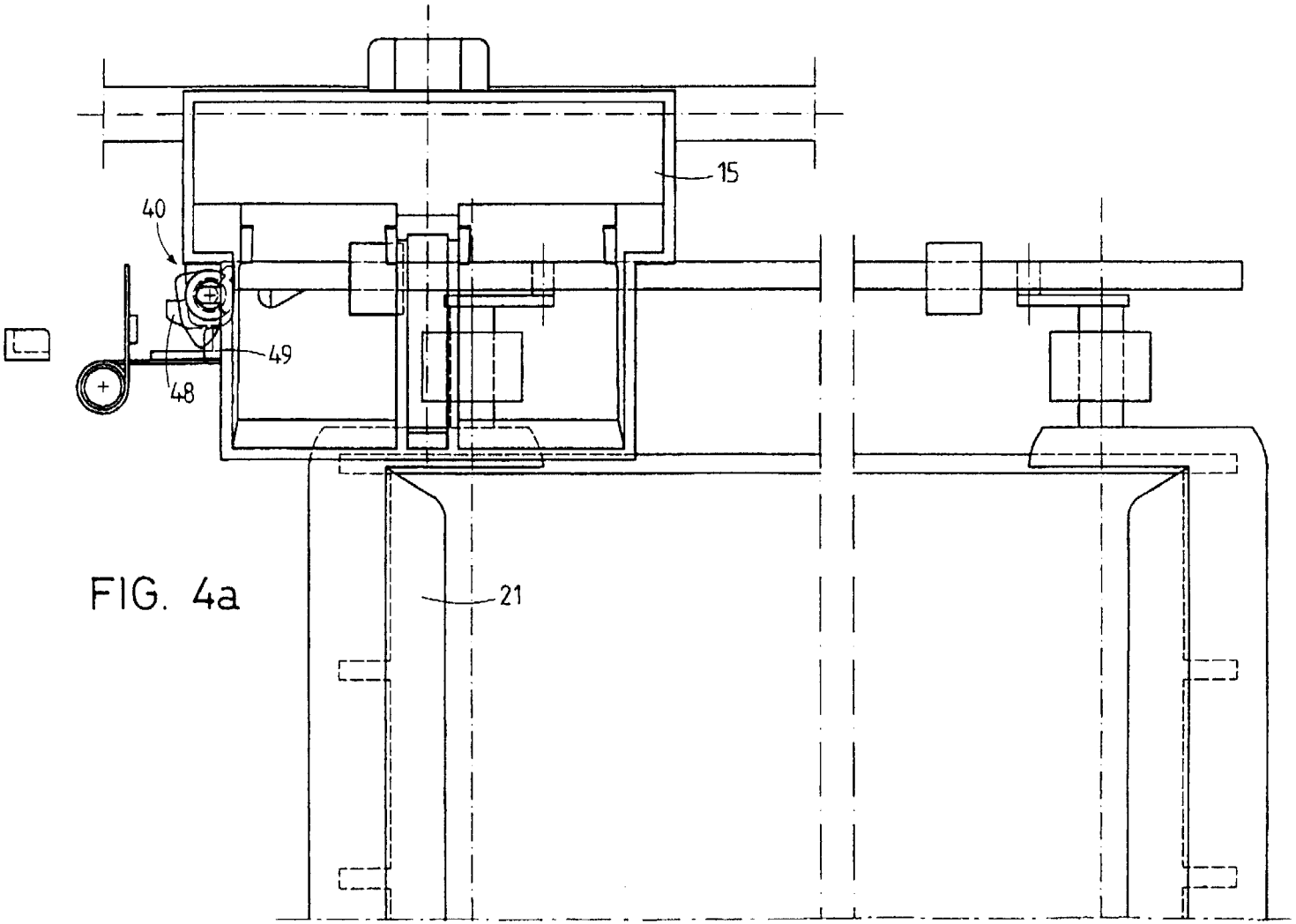
FIGS. 4*a* and 4*b* are enlarged views of the printer in a third position corresponding to the shutter open position.
Figure 4B:
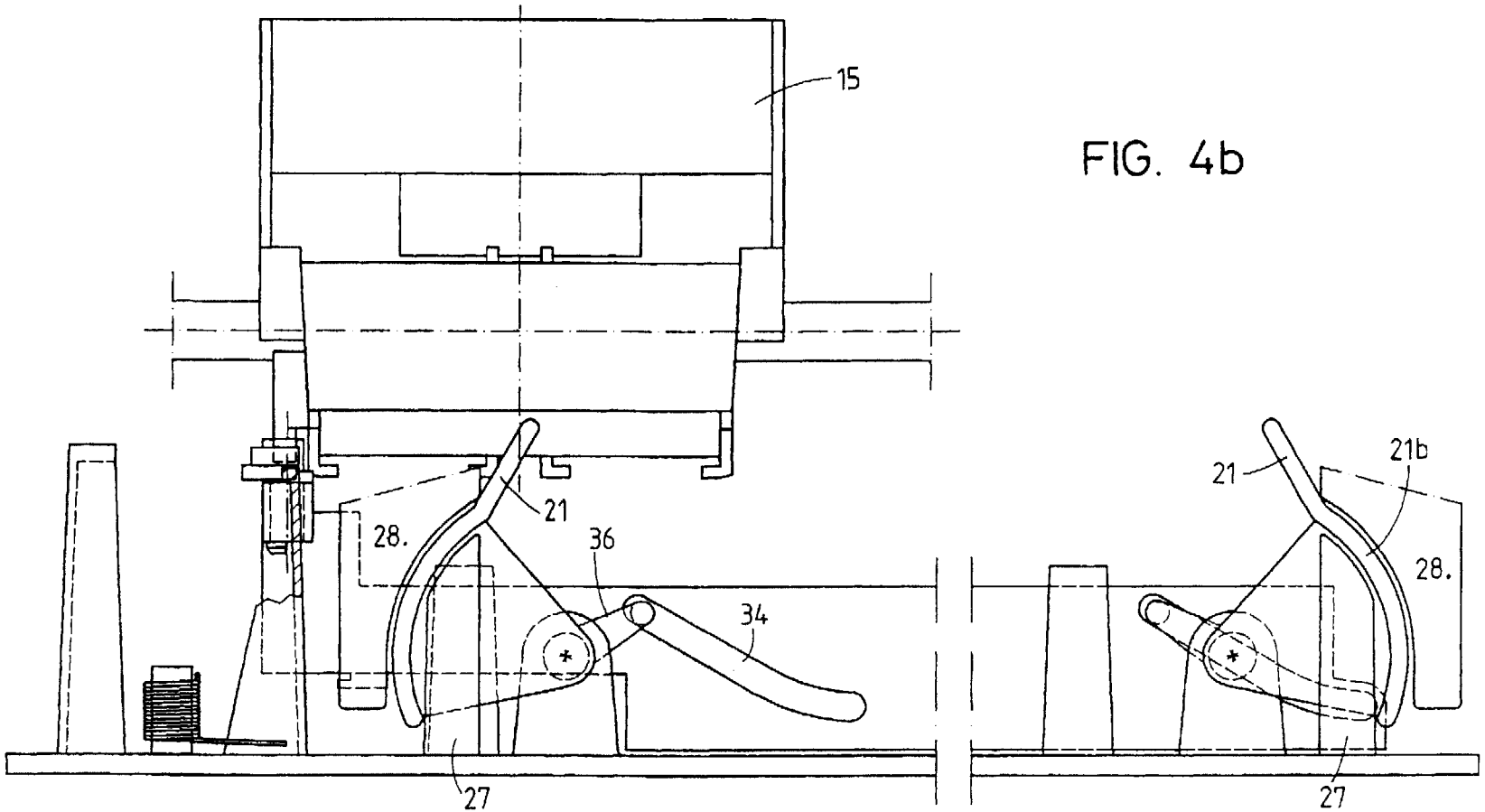

When the position shown in FIGS. 4*a* and 4*b* is reached, the shutters 21 are fully open and their rounded part is retracted between the guiding members 27, 28. The sheet placed on the shutters is dropped vertically downwardly into the collection tray 14. The lower cam 48 cooperates in this position with the second fixed abutment 49 to turn the selection pin 42 through an angle of about 90° in the clockwise direction of FIG. 4*a*. The rod 41 of the carriage 15 can then leave the recess 43 through the opening 44.

When the carriage 15 returns to the position illustrated in FIGS. 1*a* and 1*b*, it takes with it the slide 31 without however turning the selection pin 42. The shutters 21 are thus closed and the following sheet can thus be printed and placed on the shutters.

After printing of the sheet is complete, the carriage 15 again performs an overtravel to the left to actuate the selection pin and actuate the slide 31 and the shutters 21. It should be noted that this overtravel is made against the action of a spiral spring 50 fitted on a post 51 integral with the frame 23, the first and second free sections 52, 53 of which rest against the fixed abutments 54, 55. The slide 31 has a part 56 cooperating during the overtravel with the first free section 52. Accordingly the spring 50 acts as a member providing safety against accidental actuation of the selection pin 42 and a driving member facilitating departure of the carriage 15 and of the slide 31 after they become integral.

The shape of the shutters 21 is special in that they are constituted by cylindrical members having a section in the form of arc of a circle 21*b* of an angle of between 50° and 100°, preferably between 65° and 90°, being extended inwards by means of a substantially flat support part 21*a*. This shape permits excellent centring of the sheet, when it is placed on the shutters 21 by sliding during printing, while it also ensures appropriate guiding of the shutters during their opening and closing movements.

It is clear that the embodiment described in the foregoing possesses no limiting traits and that all the changes desired may be made to the interior of the frame as defined in claim 1.

In particular, the selection or retaining member 42 could be a much different mechanism.

The rod 41 could be shaped much differently and could also be integral with the slide 31; the retaining member cooperating with the rod could also be mounted on the carriage 15.

The fixed abutments 46, 48 could be arranged differently.

The shutters 21 could be shaped differently and could also be provided with pivoting shafts 24 at both ends.

The spiral spring 50 could also be dispensed with in a simplified variation.

What is claimed is:

1. An ink jet printer for recording information on a sheet comprising:

a frame;

an entrance in said frame for feeding said sheet in said printer in a feeding direction;

a printing station for printing said sheet, said printing station being supported by a printing carriage moved in a direction of movement perpendicular to said feeding direction of said sheet;

a collection tray for the printed sheet having temporary storage means for temporarily storing said printed sheet, said temporary storage means being situated above said collection tray; and feeding means for moving said sheet from said entrance to said collection tray, wherein said temporary storage means comprise:

two retractable shutters pivotingly mounted according to a pivoting axis perpendicular to said direction of movement of said carriage; and an actuating mechanism cooperating with said shutters for swiveling said shutters from a closed position, in which said printed sheet is temporarily stored on said shutters, to an open position, in which said printed sheet is dropped vertically downwardly into said collection tray, said mechanism including a slide movable back and forth in said direction of movement, and temporary linking members between said carriage and said slide, whereby movement of said carriage along said direction of movement commands movements of said slide to close or open said shutters.

2. A printer according to claim 1, wherein each shutter of said two shutters or each axis of said axes of said shutters comprises each a part intended for cooperating with a rail provided on said slide and arranged so as to actuate this part in order to open and close said shutters when said slide is moved by said carriage.

3. A printer according to claim 2, wherein said slide is constituted by a slat slidingly fitted in two posts of said frame and having two guide rails, and wherein said shutters or said axes of said shutters bear levers fitted with pins, said guide rails cooperating with said pins.

4. A printer according to claim 1, wherein said slide comprises a recess intended for cooperating with a protrusion provided on said carriage, a retaining member being fitted on said slide so as to cooperate with at least a first and a second fixed abutment and be selectively put in a closed position making said protrusion integral with said recess, and in an open position where said protrusion is no longer integral with said recess.

5. A printer according to claim 4, wherein said first fixed abutment is arranged to cooperate with said retaining member when said carriage performs a lateral, selecting overtravel beyond the printing position to make said carriage integral with said slide, and wherein said second fixed abutment is arranged to put said retaining member in said open position when said slide has performed a stroke sufficient to cause said shutters to open.

6. A printer according to claim 5, wherein said retaining member is comprised by a selection pin rotatingly mounted on said slide between a first and a second stop position, and comprising a recess which said protrusion can enter through an opening in said first stop position of said selection pin, said selection pin comprising at least one cam intended for cooperating with said first and said second fixed abutment so as to be turned from said first stop position to said second stop position.

7. A printer according to claim 5, comprising a spring mounted on said frame and cooperating with said slide so that said lateral, selecting overtravel is made against an action of said spring.

8. A printer according to claim 1, wherein each shutter of said two shutters is constituted by a cylindrical member having a section of an arc of a circle of an angle between 50° and 100°, said arc of a circle being extended towards said temporary storage means by an essentially flat part.

9. A printer according to claim 8, wherein said angle is between 65° and 90°.

* * * * *